US008096412B1

(12) United States Patent
Britt

(10) Patent No.: US 8,096,412 B1
(45) Date of Patent: Jan. 17, 2012

(54) KEY REMOTE CONTROL COVER

(76) Inventor: Willis L. Britt, Hartsville, SC (US)

( * ) Notice: Subject to any disclaimer, the term of this patent is extended or adjusted under 35 U.S.C. 154(b) by 0 days.

(21) Appl. No.: 12/765,557

(22) Filed: Apr. 22, 2010

(51) Int. Cl.
*A45C 11/32* (2006.01)
*B65D 85/38* (2006.01)
*E05B 19/00* (2006.01)

(52) U.S. Cl. ..... 206/37.3; 70/395; 70/430; 206/38.1; 206/305; 206/320

(58) Field of Classification Search ..... 206/37.1, 206/37.3, 38.1, 305, 320; 70/395, 408, 456 R, 70/398, 430
See application file for complete search history.

(56) References Cited

U.S. PATENT DOCUMENTS

D292,288 S 10/1987 Schwartz
5,083,662 A * 1/1992 Bishop et al. ..... 206/37.1
5,117,666 A 6/1992 Keefer
5,181,605 A * 1/1993 Bishop et al. ..... 206/37.1
5,388,691 A 2/1995 White
6,476,712 B1 * 11/2002 Achterholt ..... 340/447
6,669,017 B2 12/2003 Linihan
6,691,539 B2 * 2/2004 Jacob et al. ..... 70/408
6,786,332 B1 9/2004 Patrick et al.
6,805,236 B1 10/2004 Caruso et al.
7,417,193 B2 * 8/2008 Schumacher et al. ..... 206/305
7,441,651 B1 10/2008 Sullivan
2002/0008610 A1 1/2002 Peterson
2007/0040648 A1 2/2007 Bernard

* cited by examiner

*Primary Examiner* — Bryon Gehman

(57) ABSTRACT

A key remote control cover for covering the remote control portion of a remote control key to prevent inadvertent pressing of remote control buttons while handling the key includes a rigid main body portion having an interior, a closed first end, and an open second end. The main body portion is designed for surrounding the bow of a key. A slot is positioned in the closed first end of the main body portion such that the slot is designed for receiving a blade of the key therethrough while the main body portion surrounds the bow of the key.

10 Claims, 3 Drawing Sheets

KEY REMOTE CONTROL COVER

BACKGROUND OF THE DISCLOSURE

Field of the Disclosure

The disclosure relates to protective devices and more particularly pertains to a new protective device for covering the remote control portion of a remote control key to prevent inadvertent pressing of remote control buttons while handling the key.

SUMMARY OF THE DISCLOSURE

An embodiment of the disclosure meets the needs presented above by generally comprising a rigid main body portion having an interior, a closed first end, and an open second end. The main body portion is designed for surrounding the bow of a key. A slot is positioned in the closed first end of the main body portion such that the slot is designed for receiving a blade of the key therethrough while the main body portion surrounds the bow of the key.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
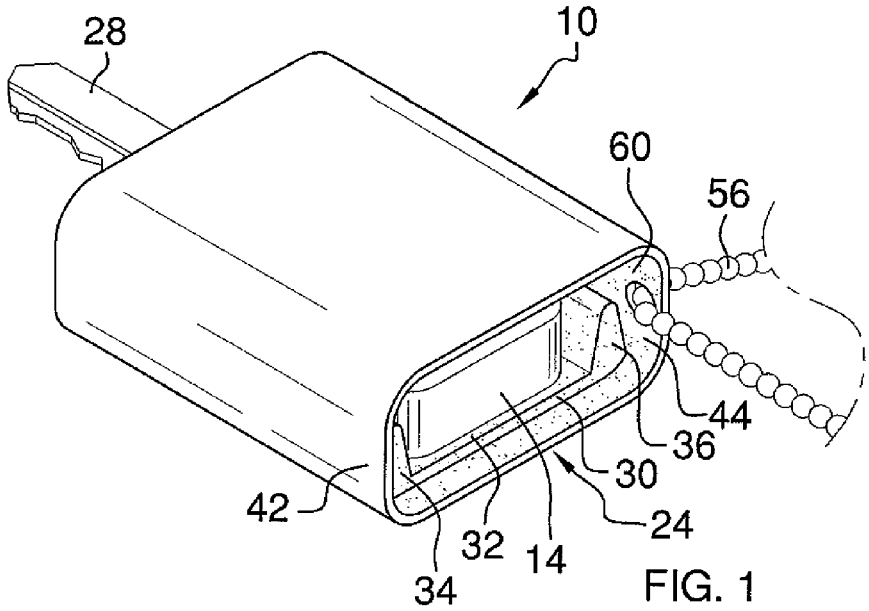
FIG. 1 is a top rear side perspective view of a key remote control cover according to an embodiment of the disclosure.
Figure 2:
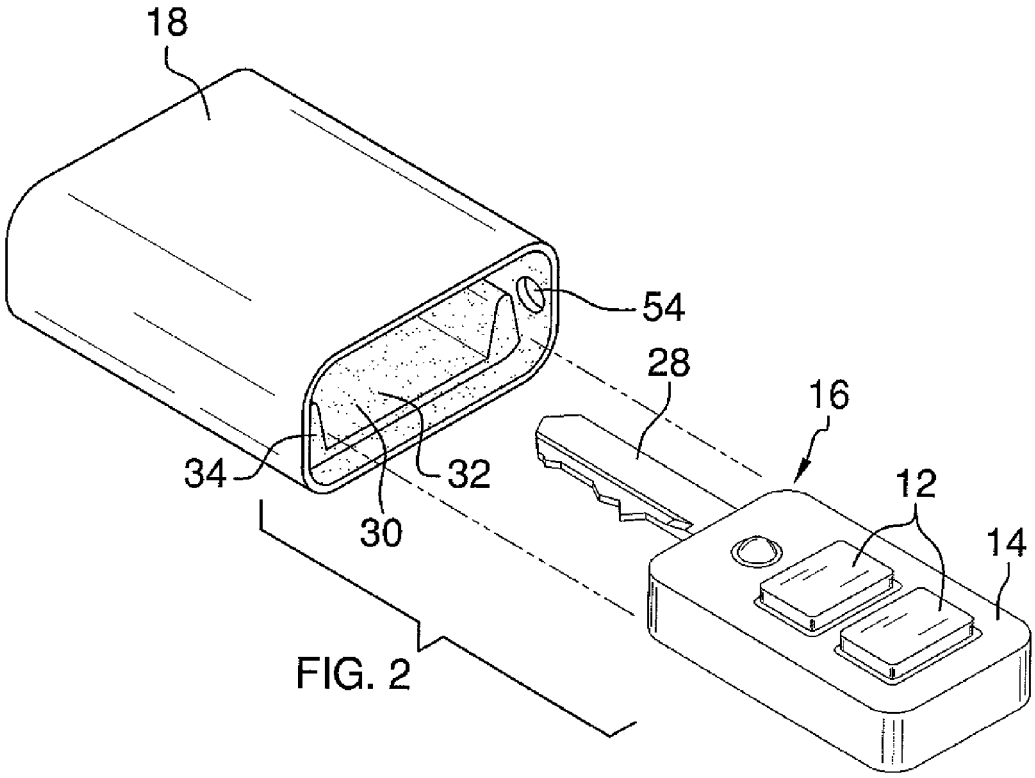
FIG. 2 is a top rear side perspective view of an embodiment of the disclosure.
Figure 3:
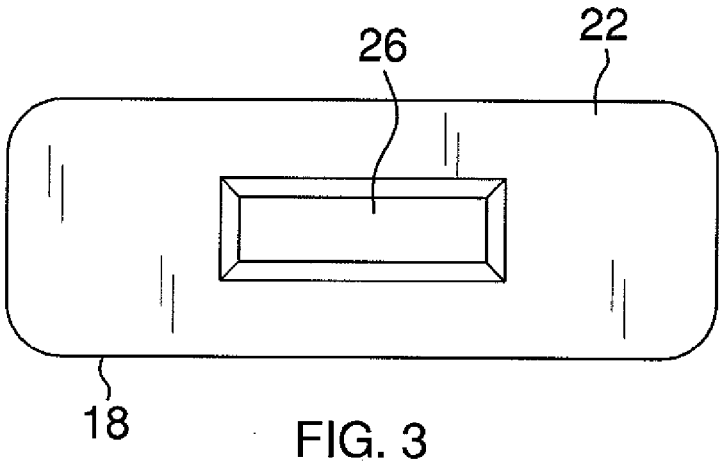
FIG. 3 is a front view of an embodiment of the disclosure.
Figure 4:
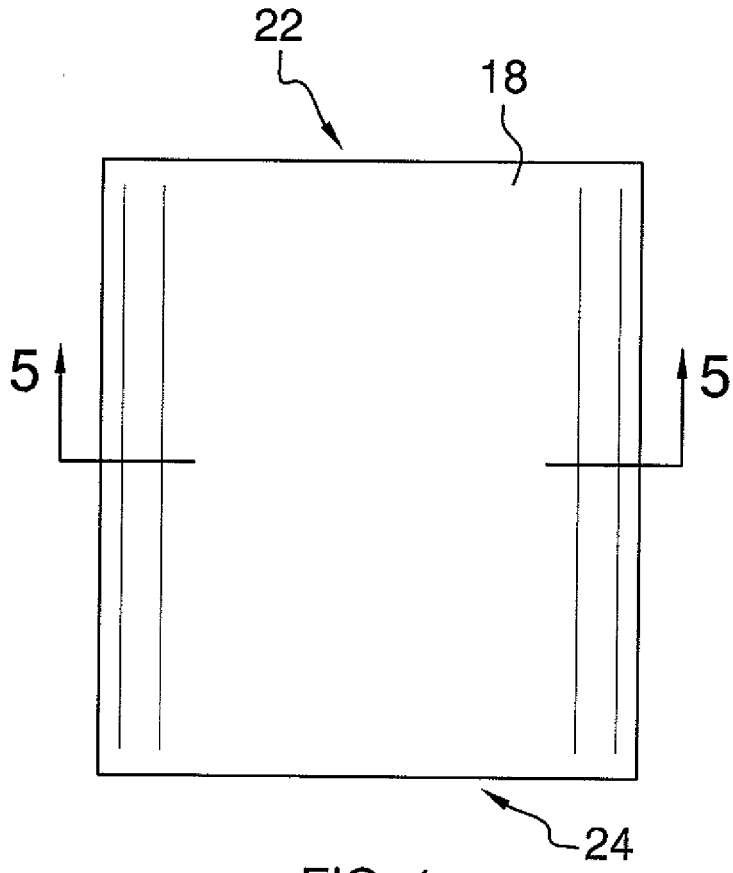
FIG. 4 is a top view of an embodiment of the disclosure.
Figure 5:
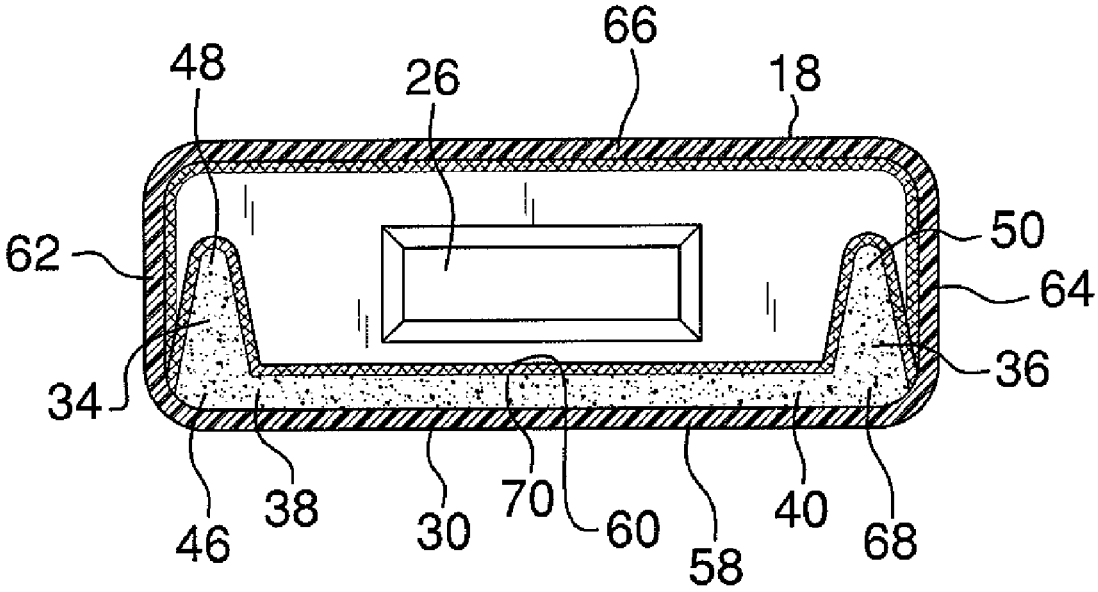
FIG. 5 is a cross-sectional view of an embodiment of the disclosure taken along line 5-5 in FIG. 4.

With reference now to the drawings, and in particular to FIGS. 1 through 5 thereof, a new protective device embodying the principles and concepts of an embodiment of the disclosure and generally designated by the reference numeral 10 will be described.

As best illustrated in FIGS. 1 through 5, the key remote control cover 10 is designed for preventing inadvertent pressing of remote control buttons 12 positioned on a bow 14 of a key 16. The key remote control cover assembly 10 generally comprises a rigid main body portion 18 having an interior 20, a closed first end 22, and an open second end 24. The main body portion 18 is designed for surrounding the bow 14 of the key 16. A slot 26 is positioned in the closed first end 22 of the main body portion 18 such that the slot 26 is designed for receiving a blade 28 of the key 16 therethrough while the main body portion 18 surrounds the bow 14 of the key 16.

A pad 30 is positioned in the interior 20 of the main body portion 18. The pad 30 is compressible and made of an elastomeric material such that the pad 30 is resilient and thus designed to frictionally engage the bow 14 of the key 16 when the bow 14 is positioned in the interior 20 of the main body portion 18 to facilitate holding the key 16 in a stable position relative to the main body portion 18.

The pad 30 includes a planar central portion 32 and a pair of wing portions 34,36. The wing portions 34,36 extend from opposite ends 38,40 of the planar central portion 32 adjacent to side portions 42,44 of the main body portion 18. The wing portions 34,36 taper extending from base portions 46,68 of the wing portions 34,36 extending from the planar central portion 32 towards distal ends 48,50 of the wing portions 34,36 relative to the planar central portion 32.

A chain aperture 54 is positioned in the main body portion 18 such that the main body portion 18 is designed for coupling to a keychain 56. The chain aperture 54 is positioned adjacent to the open second end 24 of the main body portion 18. The pad 30 is coupled to a bottom face 58 of the interior 20 of the main body portion 18.

A liner 60 is positioned in the interior 20 of the main body portion 18. The liner 60 extends along opposite side faces 62,64 and a top face 66 of the interior 20 of the main body portion 18. The liner 60 also extends along a top surface 70 of the pad 30 covering the wing portions 34,36 and the central planar portion 32.

In use the key 16 is inserted into the interior 20 of the main body portion 18. The blade 28 is inserted through the slot 26 so that the blade 28 can be inserted into a keyhole while the bow 14 is positioned within the interior 20 of the main body portion 18. The main body portion 18 prevents inadvertent pressing of the remote control buttons 12 on the bow 14 of the key 16.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure.

I claim:

1. A key remote control cover assembly for preventing inadvertent pressing of remote control buttons positioned on a bow of a key, the key remote control cover assembly comprising:

a main body portion having an interior, a closed first end, and an open second end, said main body portion being adapted for surrounding the bow of the key; and a slot positioned in said closed first end of said main body portion such that said slot is adapted for receiving a blade of the key therethrough while said main body portion surrounds the bow of the key;

a pad positioned in said interior of said main body portion, said pad being compressible such that said pad is adapted to frictionally engage the bow of the key when the bow is positioned in said interior of said main body portion to facilitate holding the key in a stable position relative to said main body portion, said pad including a planar central portion and a pair of wing portions, said wing portions extending from opposite ends of said planar central portion adjacent to side portions of said main body portion, said wing portions each having a width, said wing portions tapering as said wing portions extend upwardly from a base of said wing portions to a distal end of said wing portions relative to said planar central portion, said width of said wing portions decreasing from said bases to a respective one of said distal ends, said planar central portion and said wing portions each being comprised of an elastomeric material, said wing portions each having an outer edge facing said main body portion and an inner edge facing each other, said inner edges abutting and being connected to said central main body portion; and wherein said elastomeric material is compressed when the bow of the key is inserted into said main body portion.

2. The key remote control cover assembly of claim 1, further comprising:

a chain aperture positioned in said main body portion such that said main body portion is adapted for coupling to a keychain.

3. The key remote control cover assembly of claim 2, wherein said chain aperture is positioned adjacent to said open second end of said main body portion.

4. The key remote control cover assembly of claim 1, further including a liner positioned in said interior of said main body portion.

5. The key remote control cover assembly of claim 1, wherein said pad is coupled to a bottom face of said interior of said main body portion.

6. The key remote control cover assembly of claim 5, further including a liner positioned in said interior of said main body portion, said liner extending along opposite side faces and a top face of said interior of said main body portion.

7. The key remote control cover assembly of claim 1, wherein said pad is coupled to a bottom face of said interior of said main body portion.

8. The key remote control cover assembly of claim 7, further including a liner positioned in said interior of said main body portion, wherein said liner extends along opposite side faces and a top face of said interior of said main body portion.

9. The key remote control cover assembly of claim 8, wherein said liner extends along a top surface of said pad.

10. A key remote control cover assembly for preventing inadvertent pressing of remote control buttons positioned on a bow of a key, the key remote control cover assembly comprising:

a main body portion having an interior, a closed first end, and an open second end, said main body portion being adapted for surrounding the bow of the key;

a slot positioned in said closed first end of said main body portion such that said slot is adapted for receiving a blade of the key therethrough while said main body portion surrounds the bow of the key;

a pad positioned in said interior of said main body portion, said pad being compressible such that said pad is adapted to frictionally engage the bow of the key when the bow is positioned in said interior of said main body portion to facilitate holding the key in a stable position relative to said main body portion;

wherein said pad includes a planar central portion and a pair of wing portions, said wing portions extending from opposite ends of said planar central portion adjacent to side portions of said main body portion;

wherein said wing portions taper extending from a base portion of said wing portions extending from said planar central portion towards a distal end of each of said wing portions relative to said planar central portion;

said planar central portion and said wing portions each being comprised of an elastomeric material, said wing portions each having an outer edge facing said main body portion and an inner edge facing each other, said inner edges abutting and being connected to said central main body portion;

wherein said elastomeric material is compressed when the bow of the key is inserted into said main body portion;

a chain aperture positioned in said main body portion such that said main body portion is adapted for coupling to a keychain;

wherein said chain aperture is positioned adjacent to said open second end of said main body portion;

wherein said pad is coupled to a bottom face of said interior of said main body portion;

a liner positioned in said interior of said main body portion, wherein said liner extends along opposite side faces and a top face of said interior of said main body portion; and wherein said liner extends along a top surface of said pad covering said wing portions and said planar central portion.

* * * * *